United States Patent [19]

Takahashi et al.

[11] 4,190,445

[45] Feb. 26, 1980

[54] ELECTROPHOTOGRAPHIC PHOTOSENSITIVE MEDIA AND PROCESS FOR MANUFACTURING THEREOF

[75] Inventors: Teruomi Takahashi, Yokohama; Takehiko Matsuo, Kawasaki, both of Japan

[73] Assignee: Canon Kabushiki Kaisha, Tokyo, Japan

[21] Appl. No.: 840,019

[22] Filed: Oct. 6, 1977

Related U.S. Application Data

[63] Continuation of Ser. No. 666,778, Mar. 15, 1976, abandoned.

[30] Foreign Application Priority Data

Mar. 20, 1975 [JP] Japan ..... 50-33775

[51] Int. Cl.[2] ..... G03G 13/00; G03G 5/04; G03G 5/08

[52] U.S. Cl. ..... 430/66; 430/132

[58] Field of Search ..... 96/1 R, 1.5, 1.8, 48 PD, 96/50 PL; 427/63, 64

[56] References Cited

U.S. PATENT DOCUMENTS

| | | | |
|---|---|---|---|
| 3,085,051 | 4/1963 | Hamm et al. | 96/1.5 |
| 3,471,625 | 10/1969 | Adams et al. | 96/1.8 |
| 3,597,259 | 8/1971 | Wainer | 96/64 |
| 3,607,258 | 9/1971 | Hoegl et al. | 96/1.5 |
| 3,615,388 | 10/1971 | Gundlach | 96/1.5 |
| 3,617,265 | 11/1971 | Petruzella | 96/1.5 |
| 3,652,271 | 3/1972 | Bornarth et al. | 96/1.8 |
| 3,700,449 | 10/1972 | Lerner | 96/1.8 |
| 3,776,627 | 12/1973 | Ohnishi et al. | 96/1 R |
| 3,778,264 | 12/1973 | Arai et al. | 96/1.5 |
| 3,847,606 | 11/1974 | Schwartz | 96/1.5 |
| 3,909,262 | 9/1975 | Goffe et al. | 96/1.5 |
| 3,912,511 | 10/1975 | Gerace et al. | 96/1.5 |
| 3,932,179 | 1/1976 | Perez-Albuerne | 96/87 A |
| 3,953,207 | 4/1976 | Horgan | 96/1.5 |

FOREIGN PATENT DOCUMENTS

| | | | |
|---|---|---|---|
| 2344777 | 3/1974 | Fed. Rep. of Germany | 96/1.5 |
| 960871 | 6/1964 | United Kingdom | 96/1.5 |

*Primary Examiner*—Travis Brown
*Assistant Examiner*—Louis Falasco
*Attorney, Agent, or Firm*—Fitzpatrick, Cella, Harper & Scinto

[57] ABSTRACT

An electrophotographic photosensitive member comprises a photoconductive insulating binder layer and a clearcoling layer overlying said photoconductive insulating binder layer and essentially consisting of a resin having an acid group in the molecule. The clearcoling layer may be produced by applying an aqueous coating material composed of a resin having a neutralized acid group and then drying.

14 Claims, 1 Drawing Figure

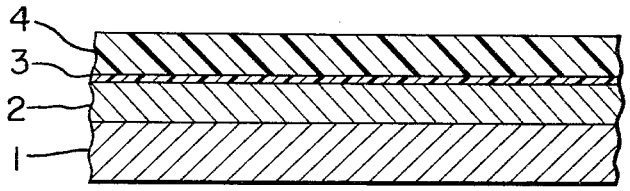
4
3
2
1

ELECTROPHOTOGRAPHIC PHOTOSENSITIVE MEDIA AND PROCESS FOR MANUFACTURING THEREOF

This is a continuation of application Ser. No. 666,778, filed Mar. 15, 1976, now abandoned.

BACKGROUND OF THE INVENTION

1. Field of the Invention

This invention relates to an electrophotographic photosensitive medium having a clearcoling layer on a photoconductive insulating binder layer.

2. Description of the Prior Art

Heretofore, there have been known photosensitive members having a photoconductive insulating binder layer containing photoconductive materials dispersed in a binder. In such photosensitive members, the ratio of the photoconductive materials to the binder directly determines the characteristics of the photosensitive member. When a large proportion of binder is used, the electric resistance of the photoconductive insulating binder layer becomes so high that the photoconductive characteristics are lowered and thereby the photosensitive member can not be practically used for electrophotography. Therefore, the binder is usually used at a proportion less than 50% by weight based on the photoconductive material. However, in such case the resulting photoconductive insulating binder layer contains a lot of interstices and is porous, and the surface is uneven. Such state of a photoconductive insulating binder layer adversely affects the characteristics of the layer. For example, the photoconductive material directly appears at the surface of the photoconductive insulating binder layer and is subjected to various types of mechanical, physical and chemical damage.

For example, since transferring paper, cleaning blades and rollers always contact the surface of the photoconductive layer in the transferring step, cleaning step etc., the surface is scratched or abraded. Further, the photoconductive layer is adversely subjected to temperature, humidity, light, dust etc., and when dry developers are used, the developers fill the dent portions on the uneven surface and can not be easily cleaned. In addition, when a liquid developer is used, the photoconductive insulating binder layer is deteriorated by an organic solvent used as a dispersion medium and the deterioration is larger as the proportion of the binder is less.

Electrophotographic photosensitive members having an electrically-insulating layer on a photoconductive insulating binder layer have been widely known which are very useful for electrophotographic processes comprising charging an electrically-insulating layer surface to impart electric charge and forming electrostatic latent images due to the electric charge, for example, the processes disclosed in U.S. Pat. No. 3,666,363 and U.S. Pat. No. 7,734,609.

In the above mentioned electrophotographic photosensitive members, the electrically-insulating layer as a surface layer serves as a protective layer so that many of the above mentioned troubles can be eliminated.

However, the adhesion between the electrically-insulating layer and the photoconductive insulating binder layer is not always good, and in general, the less the proportion of the binder, the weaker the adhesion. Thus, when the adhesion is not strong, the previously mentioned troubles can occur again.

For the purpose of improving this adhesion, an electrically-insulating material is dissolved in an appropriate solvent to produce a liquid coating material for forming an electrically-insulating layer and coated on the surface of a photoconductive insulating binder layer, or an electrically-insulating sheet is adhered to the surface of a photoconductive insulating binder layer with an appropriate adhesive. However, such methods have the following disadvantages. That is, for the purpose of not deteriorating characteristics of the electrophotographic photosensitive member, a binder of less than 50% by weight is used to form a photoconductive insulating binder layer, and an electrically-insulating layer material is applied to the surface of the resulting photoconductive insulating binder layer. In this case, the electrically-insulating layer material penetrates into the interstices in the photoconductive insulating binder layer and fills the interstices so that photoconductive characteristics of the photoconductive insulating binder layer are lowered to a great extent, or a solvent for the electrically-insulating layer material penetrates into the interstices of the photoconductive insulating binder layer and thereby loosens the binding by the binder and as the result, characteristics of the electrophotographic photosensitive member are lowered and in addition, air bubbles from the photoconductive insulating binder layer enter the electrically-insulating layer upon forming said electrically-insulating layer resulting in deterioration of dielectric strength at a portion where the air bubble is present and formation of pin holes.

Further, electrostatic latent images forming characteristics upon charging a surface of an electrically-insulating layer and forming electrostatic latent images based on the electric charge largely depend on an interfacial state between the electrically-insulating layer and the photoconductive insulating binder layer as well as characteristics of the electrically-insulating layer itself. For example, when a photoconductive insulating binder layer possesses characteristics of n-type semiconductor and positive electric charge is given, the positive electric charge is charged on the electrically-insulating layer simultaneously with injection of negative charge from the base plate side and the negative charge is trapped at a portion near the interface between the electrically-insulating layer and the photoconductive insulating binder layer. The negative charge thus trapped attracts the positive charge on the electrically-insulating layer through the electrically-insulating layer resulting in substantially charging positive charge on the electrically-insulating layer. In this case, if the surface of the photoconductive insulating binder layer is uneven, or said layer itself is porous, the electric charge thus bound becomes non-uniform, and electric charge on the corresponding electrically-insulating layer surface also becomes non-uniform and as the result, the electrostatic latent images formed based on such state of electric charge can not be good and if the electric charge is so non-uniform, the resulting electrostatic latent images can not be practically used.

When the surface of the photoconductive insulating binder layer is uneven and the binder layer is porous, the electrically-insulating layer formed on the surface of the binder layer can be neither of uniform thickness nor of smooth surface. This deteriorates electric charging state to a great extent as mentioned above.

When an adhesive is employed, the results are almost similar to above. That is, when an electrically-insulating layer sheet is adhered to the surface of the photoconductive insulating binder layer with an adhesive regardless of a solvent type or non-solvent type, the adhesive component itself or the solvent penetrates into the interstices of the photoconductive insulating binder layer so that undesirable results similar to the case of coating an electrically-insulating layer material directly to the photoconductive insulating binder layer. Further, upon adhering the electrically-insulating layer with an adhesive, a pressure is applied from the electrically-insulating layer sheet side or the photoconductive insulating binder layer side so as to avoid wrinkles and keep the thickness of adhesive between the two layers uniform, and therefore the penetration is more accelerated.

For the purpose of solving those problems in the prior art electrophotographic photosensitive member, there has been proposed to coat the surface of a photoconductive insulating binder layer surface with a clearcoling layer by U.S. Ser. No. 391,761 filed Aug. 27, 1973 abandoned and German Patent Publication (DAS) No. 2344777. These inventions relate to an electrophotographic photosensitive medium comprising a photoconductive layer composed of inorganic photoconductive particles dispersed in a water-insoluble binder, a clearcoling layer on the photoconductive layer and composed of organic solvent-resistant, water-soluble, cohesive materials and an electrically-insulating layer on the clearcoling layer. In the inventions, it is disadvantageous that a material of particularly limited conditions such as organic solvent-resistant, water-soluble, and cohesive material should be used as the clearcoling layer. In addition, since the clearcoling layer material is water-soluble, apts to absorb moisture. Such hygroscopic property is not so serious a problem when the member has an electrically-insulating layer, unless the member is used under particularly severe conditions. However, in case of an electrophotographic member having no electrically-insulating layer, the clearcoling layer is directly exposed to outside atmosphere so that if the member is used in a highly humid atmosphere for a relatively long time, the hygroscopic clearcoling layer absorbs moisture and the electrostatic latent images formed thereon are disturbed (lowering of electrostatic contrast) resulting in obtaining poor transferred images.

SUMMARY OF THE INVENTION

An object of the present invention is to provide an electrophotographic photosensitive medium free from the above mentioned drawbacks and having a clearcoling layer possessing excellent characteristics.

Another object of the present invention is to provide a process for manufacturing such an electrophotographic photosensitive medium as above.

A further object of the present invention is to provide an electrophotographic photosensitive medium having a clearcoling layer which is not so hygroscopic that electrostatic contrast is not lowered, and having stable environment characteristics.

Still another object of the present invention is to provide a process for manufacturing an electrophotographic photosensitive medium in which a non-hygroscopic clearcoling layer is produced from a water-soluble or -dispersible resin.

A still further object of the present invention is to provide an electrophotographic photosensitive medium having a surface-smoothed electrically-insulating layer of uniform thickness.

Still another object of the present invention is to provide an electrophotographic photosensitive medium having a photoconductive insulating binder layer having characteristics as originally produced without penetration of the clearcoling layer material.

A still further object of the present invention is to provide an electrophotographic photosensitive medium which is not hazardous to man and is suitable for commercial production, and a process for production thereof.

According to one aspect of the present invention, there is provided an electrophotographic photosensitive medium which comprises a photoconductive insulating binder layer, a clearcoling layer on said photoconductive insulating binder layer and essentially consisting of a resin having an acid group in a molecule, and if desired, a smooth-surfaced electrically-insulating layer on said clearcoling layer.

According to another aspect of the present invention, there is provided an electrophotographic photosensitive drum element which comprises a cylindrical, electrically-conductive base, a seamless photoconductive insulating binder layer on the base, a seamless clearcoling layer on the photoconductive insulating binder layer and essentially consisting of a resin having an acid group in a molecule, and if desired, a seamless, smooth-surfaced electrically-insulating layer on the clearcoling layer.

According to a further aspect of the present invention, there is provided a process for manufacturing an electrophotographic photosensitive medium which comprises the steps of: forming a photoconductive insulating binder layer on a base, applying to the surface of the photoconductive insulating binder layer an aqueous coating material produced by neutralizing a resin having an acid group in a molecule with a basic compound and dissolving or dispersing the resin thus neutralized in water, drying the aqueous coating material thus applied to produce a clearcoling layer, and if desired, forming a smooth-surfaced electrically-insulating layer on the clearcoling layer.

BRIEF DESCRIPTION OF THE DRAWING

The FIGURE is a diagrammatical cross sectional view of an embodiment of an electrophotographic photosensitive medium according to the present invention.

DESCRIPTION OF THE PREFERRED EMBODIMENTS

Referring to the FIGURE, reference numerals 1, 2, 3 and 4 denote a base, a photoconductive insulating binder layer, a clearcoling layer and an electrically-insulating layer, respectively. The electrophotographic photosensitive medium may be produced by forming photoconductive insulating binder layer 2 on base 1, applying to the surface of photoconductive insulating binder layer 2 an aqueous coating material produced by neutralizing a resin having an acid group with a basic compound and dissolving the resin thus neutralized in water and drying to form clearcoling layer 3, and forming a smooth-surfaced electrically-insulating layer 4 on clearcoling layer 3.

Another embodiment of the electrophotographic photosensitive medium is that of the FIGURE in which the smooth-surfaced electrically-insulating layer 4 is omitted.

The important feature of the present invention is using a resin having an acid group in the molecule as a material for a clearcoling layer overlying a photoconductive insulating binder layer.

An acid group is hydrophilic and hygroscopic. The degree of hygroscopic property depends on the balance between hydrophobic properties of main chains and substituents in the resin and the acid groups.

The less the number of an acid group per unit weight, an acid value, in a resin which is inherently hygroscopic, the less the hygroscopic property. And at an acid value lower than a certain limit the resin is substantially non-hygroscopic. Therefore, a resin having only a small number of acid group is water-insoluble or non-dispersible in water. However, such resin can be converted to a water-soluble or water-dispersible resin (capable of being dispersed in water in a form of fine particle) by neutralizing the acid group with a basic compound.

In other words, a resin having an acid group of an acid value less than the above mentioned certain limit can be converted to water-soluble and water-dispersible one.

In case of resins having a hydrophilic group such as hydroxy, methylol, amino, polyoxyethylene and the like, the resin is water-soluble only when there are a large number of the hydrophilic group. When such resin is used as a clearcoling layer, electrophotographic characteristics of the resulting electrophotographic photosensitive member are very poor because of hygroscopic property of the resin containing a large number of acid group for the purpose of imparting wter-solubility.

As mentioned above, it is necessary to introduce hygroscopic groups sufficient for rendering the resin water-soluble or water-dispersible into the resin molecule.

In case of acid groups, when the acid groups are neutralized, the resulting resin is rendered water-soluble or water-dispersible even if the number of acid group in the resin molecule is less than that of other hydrophilic groups. Therefore, hygroscopic property of the resin when the basic compound portion has been released becomes very low and thereby the resin becomes substantially non-hygroscopic. The hygroscopic property as referred to here means that which affects electric properties of a resin and therefore, the degree of hygroscopic property is far different from that used in usual.

It depends on acid value, molecular weight of the resin and amount of the added basic compound whether the resin thus neutralized becomes water-soluble or water-dispersible.

When an aqueous coating material for clearcoling layer is applied to a photoconductive insulating binder layer, the resin in the aqueous coating material does not penetrate into the photoconductive insulating binder layer because surface tension of water is very high and thereby fine interstics in the photoconductive insulating binder layer are not filled with the resin. Neither penetrates the water into the photoconductive insulating binder layer. Usually the water is evaporated within only a short time and the clearcoling layer is formed.

As compared with various organic solvents, water is inexpensive and harmless and does not cause any pollution.

Since the resin for clearcoling layer remains on the surface of the photoconductive insulating binder layer without penetrating into the photoconductive insulating binder layer, dent portions of the uneven surface of the photoconductive insulating binder layer are filled and thereby a smooth-surface is formed. Therefore, when an electrically-insulating layer coating material is applied thereto, neither the coating material nor the solvent therefor penetrates into the photoconductive insulating binder layer. Thus the resulting electrically-insulating layer is a smooth-surfaced one of a uniform thickness.

According to the present invention, an aqueous coating liquid for producing the clearcoling layer may be produced by neutralizing an acid group of a resin having an acid group. This procedure is usually conducted by dissolving or dispersing the resin in an aqueous solution of a base adjusted to an appropriate pH. In general, it is preferable that the aqueous solution is somewhat excess basic, for the purpose of completely neutralizing the acid group. However, it does not matter that the aqueous solution is less basic because in such case the liquid portion containing the dissolved or dispersed resin can be taken out and used as an aqueous coating material. Thus there is not any excess base and such aqueous coating material is preferable as shown later.

Although it is not desired to limit the invention to any particular theory, the mechanism of formation of the clearcoling layer may be as shown below. For example, assuming that the acid group is carboxyl group, a resin having carboxyl group is usually water-insoluble and not water-dispersible, but the resin can be dissolved or dispersed in water to produce an aqueous coating material by neutralizing the resin with, for example, ammonia. When this aqueous coating material is applied to the surface of a photoconductive insulating binder layer and dried, the neutralized resin is reverted to the original resin having carboxyl group which is water-insoluble and not water-dispersible and a non-hygroscopic film is formed. This process may be represented by the following flow sheet.

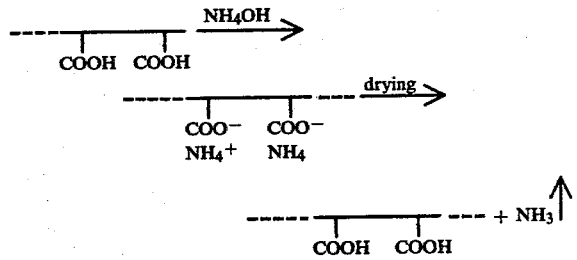

For the purpose of proceeding the above reaction effectively to the right direction, i.e. irreversibly, it is desirable that the released basic compound or its derivatives do not remain in the clearcoling layer. Therefore, the basic compound is preferably a volatile compound.

If a non-volatile basic compound such as sodium hydroxide is used as the neutralizing agent, removal of the alkali residue ($Na^+$) from the acid group is very difficult during the formation of the clearcoling layer. Even if it can be released as sodium hydroxide again, the sodium hydroxide remains in the clearcoling layer and its removal is very difficult and what is worse, sodium hydroxide is so hygroscopic that electrophotographic characteristics of the resulting photosensitive medium is deteriorated to a great extent.

Representative volatile basic compounds are ammonia, amines, for example, lower alkyl amines such as methylamine, dimethylamine, trimethylamine, ethylamine, diethylamine, triethylamine, propylamine, isopropylamine, butylamine, diisopropylamine and the like. These may be used alone or in combination.

According to the present invention, a volatile basic compound is preferably used for neutralizing the acid group of the resin for a clearcoling layer.

As the clearcoling layer is dried, the basic compound portion can be released and the basic compound thus released is evaporated off. It is preferable to heat the clearcoling layer for accelerating such action.

The resulting state of the clearcoling layer depends on the state of the solution or dispersion of the aqueous coating material. When the aqueous coating material is a solution or solution-like state, the resulting clearcoling layer is a dense film and has interstices as small as molecular order of network structure of high polymer so that when an electrically-insulating layer is coated on the clearcoling layer, the insulating material or the solvent does not penetrate into the photoconductive insulating binder layer.

However, when an aqueous dispersion containing resins of a fairly large particle size which is usually observed as an opaque suspension is used, the resulting clearcoling layer sometimes contains interstices larger than a molecular order interstices of network structure of high polymer as well as molecular order interstices. In this case, it is preferable to eliminate such interstices in the layer by heating the resin to a temperature higher than the melting point thereof after forming the clearcoling layer.

Further, if necessary, the aqueous coating material may be applied twice or more including such heating procedure for producing the clearcoling layer.

The relation between acid value of the resin used for the clearcoling layer and the electrophotographic characteristics of the electrophotographic photosensitive media at highly humid state is as shown below. When the acid value exceeds 280 (5 moles of acid group per one kilogram of resin), the photosensitive media can not be practically used from electrophotographic point of view. The acid value is a gram number of KOH necessary for neutralizing acid groups in 1 Kg. of a resin. According to the present invention, the acid value of the resin is preferably not higher than 280, more preferably, not higher than 168 (3 moles of acid group per one kilogram of resin) further more preferably not higher than 56 (1 mole of acid group per one kilogram of resin). It is to be noted that the above numerical limit is determined assuming that the resin does not contain any hydrophilic groups other than an acid group.

Therefore, an electrophotographic photosensitive medium having excellent electrophotographic characteristics even at a highly humid state can be produced by using a resin having not more than 5 moles of acid group per one kilogram of resin (acid value:280), preferably not more than 3 moles of acid group per one kilogram of resin (acid value:168), and more preferably, not more than one mole of acid group per one kilogram of resin (acid value:56) as a material for the clearcoling layer.

The lower limit of number of acid group in the resin molecule depends on the molecular structure, molecular weight etc. of the resin, but according to the present invention, it is necessary only that there are sufficient acid groups capable of rendering the resin water-soluble or water-dispersible when neutralized with a basic compound. The lower limit is usually 0.1 mole of acid group per one kilogram of resin (acid value:5.6), preferably 0.5 moles of acid group per one kilogram of resin (acid value:28).

According to the present invention, preferable acid groups are carboxyl group and sulfonic acid group.

Representative resins having an acid group in a molecule are synthetic resins such as vinyl acetate-acrylic acid copolymer, vinyl chloride-vinyl acetate-acrylic acid terpolymer, ethylene-acrylic acid copolymer, styrene-acrylic acid copolymer, butadiene-acrylic acid copolymer, $\alpha$, $\omega$-polybutadiene dicarboxylic acid, vinyl acetate-ethylene sulfonic acid copolymer, styrene-ethylene sulfonic acid copolymer, vinyl acetate-methacrylic acid copolymer, vinyl chloride-methacrylic acid copolymer, styrene-methacrylic acid copolymer and the like. The resin may be used alone or in combination.

The thickness of the clearcoling layer is usually not more than 10 microns, preferably not more than 7 microns. When the thickness is more than 10 microns, the total thickness of the layers on the photoconductive insulating binder layer becomes too thick to produce a sharp toner image in case of an electrophotographic photosensitive medium having an electrically-insulating layer on the clearcoling layer. The lower limit of thickness of the clearcoling layer may be very thin as far as the resulting clearcoling layer satisfies the purpose of the present invention. However, in practice, the thickness is limited by a thin film forming technic and is usually about 0.5 microns.

Photoconductive materials in the photoconductive insulating binder layer may be inorganic photoconductive materials such as $Cu_2O$, CuI, ZnO, ZnS, ZnSe, CdS, Se—Te, CdSe, CdTe, PbS, $Sb_2O_3$, $In_2Te_3$, GeS, GeSe, $Te_2S$ and the like, and if necessary, the inorganic photoconductive materials may be used in combination with organic photoconductive materials such as anthracene, 3,6-dibromo poly-N-vinylcarbazole, nitrated poly-N-vinylcarbazole, polyvinylanthracene and the like.

As a binder for the photoconductive insulating binder layer, there may be used thermosetting resins such as epoxy resins, unsaturated polyester resins, melamine resins, silicone resins, and thermoplastic resins soluble in a solvent such as vinyl chloride-vinyl acetate copolymers, vinyl chloride resins, vinyl acetate resins, acetyl cellulose resins, nitrocellulose resins, methacryl resins, polyvinyl alcohol, polyvinyl butyral and the like. These binder resins may be used alone or in combination.

According to conventional method for producing an electrophotographic photosensitive medium having an electrically-insulating layer, a film such as polytetrafluoroethylene and polyethylene terephthalate is adhered to the surface of the photoconductive insulating binder layer with an adhesive to form an electrically-insulating layer. However, when such method is applied to a drum type electrophotographic photosensitive medium, there is formed a seam, and upon copying, electrostatic latent images should be produced avoiding the seam portion. Therefore, mechanism of the electrophotographic process should be synchronized with the rotation of the drum and thereby the apparatus becomes complicated. On the contrary, the photoconductive insulating binder layer, clearcoling layer and electrically-insulating layer of the photographic photosensitive medium according to the present invention can be produced by dip-coating so that a drum type photosensitive member without seam can be produced easily, and the above mentioned problem can be solved.

As the base of such drum type electrophotographic photosensitive member, a conductive cylindrical drum such as aluminum drum may be used.

The following examples are given for illustrating the present invention, but not for limiting the present invention.

EXAMPLE 1

100 parts by weight of an activated photoconductive cadmium sulfide, 10 parts by weight of a vinyl chloride-vinyl acetate copolymer, and 10 parts by weight of methyl isobutyl ketone as a diluent were mixed and sufficiently dispersed by a roll-mill to produce a paste-like photoconductive composition. Methyl ethyl ketone was added to the resulting composition to adjust the viscosity to 700 cps. at 20° C. An aluminum cylindrical drum was dipped in the liquid composition, pulled out at a speed of 30 mm/min., and dried at 70° C. for 20 minutes to evaporate completely the solvent resulting in the formation of a photoconductive layer of 50 microns thick. The drum thus coated was dipped in an aqueous dispersion (70 cps. at 20° C.) produced by neutralizing carboxyl groups of $\alpha$, $\omega$-polybutadiene dicarboxylic acid resin (acid value:about 56), pulled out at a speed of 30 mm./min., and dried at 70° C. for 30 min. to evaporate water and ammonia to produce a clearcoling layer of 4 microns thick on the photoconductive layer. Further the drum was dipped in a solution (70 cps. at 20° C.) of a urethan-acryl resin of light curing type ("SONNE CK-8", trade name, supplied by Kansai Paint Corp.) in ethyl alcohol, pulled out at a speed of 30 mm./min. to form a thin film of said resin on the clearcoling layer, irradiated by ultraviolet ray for 100 sec. in an ultraviolet ray irradiation device to cure the resin to produce an electrically-insulating layer. The thickness of the electrically-insulating layer obtained by one coating procedure was 10 microns. Therefore, two more coating procedures were conducted to produce the electrically-insulating layer of 30 microns in thickness in total. The electrically-insulating layer of the electrophotographic photosensitive medium thus produced has a uniform thickness and a highly smooth-surface and is completely free from air bubbles.

The resulting seamless drum photosensitive member was subjected to an electrophotographic process of U.S. Pat. No. 3,666,363 or U.S. Pat. No. 3,734,609 by primary charging, imagewise exposure simultaneously with or afterward AC discharging or DC charging with a polarity opposite to said primary charging, whole surface exposure and development.

The resulting copy image was excellent. The above photosensitive member (Sample A) was allowed to stand in a highly humid atmosphere and the electrostatic contrasts at a dry state and after stood in the highly humid atmosphere were measured and compared with other control samples as shown in Table 1 below. Sample A showed an excellent environment characteristic.

Table 1

Humid atmosphere : stood at 35° C., 85% RH, for 48 hours

| | Resin of clearcoling layer | Electrostatic contrast at a dry state | Electrostatic contrast immediately after stood in the humid atmosphere |
|---|---|---|---|
| Sample A | $\alpha,\omega$-Polybutadiene dicarboxylic acid | 630 V | 600 V |
| Control sample 1 | Polyvinyl alcohol | 620 V | 100 V |
| Control sample 2 | None | 620 V | 610 V |

Control sample 1:

An electrophotographic photosensitive member similar to that of Sample A except that the clearcoling member was produced by dipping the drum in an aqueous polyvinyl alcohol.

Control sample 2:

An electrophotographic photosensitive member produced by following the procedure employed for producing Sample A up to the formation of the photoconductive layer and then closely contacting a polyester film having a solvent type adhesive on the surface where the solvent was sufficiently evaporated so as to avoid the penetration of the adhesive into the photoconductive layer when the adhesive was brought into contact with the surface of the photoconductive layer.

As is clear from Table 1 above, electrostatic contrast of Sample A is not so lowered at the humid atmosphere and is similar to that of Control sample 2 while electrostatic contrast of Control sample 1 using polyvinyl alcohol as clearcoling layer is lowered to a great extent in the humid atmosphere.

EXAMPLE 2

In a way similar to the procedure of Example 1, a photoconductive layer was formed in the thickness of 50 microns on an aluminum base. Then, an aqueous dispersion coating material (80 cps. at 20° C.) produced by neutralizing ethylene-acrylic acid copolymer resin (acid value: about 62) with ammonia was coated on the photoconductive layer as a clearcoling layer by a dip-coating (pulling out at a speed of 30 mm./min.), dried by heating at 70° C. for 20 min. to form a layer of 6 microns thick, and then, immediately, irradiated by a 600 W infrared ray heater at a distance of 3 cm. for 5 sec. to melt and flow the resin resulting in forming the finished clearcoling layer. On the resulting clearcoling layer was coated a solution (75 cps. at 20° C.) of a light-curing type urethan-acryl resin ("SONNE Ck-8", trade name, supplied by Kansai Paint Corp.) in a mixture of methyl alcohol and methyl ethyl ketone (1:1) by a dip-coating in the same way as in Example 1 to produce an electrically-insulating layer. Thus an electrophotographic photosensitive medium (Sample B) was produced. When this photosensitive medium (Sample B) was subjected to an electrophotographic process similar to that of Example 1, there was obtained a very good copy image.

Repeating the above procedure except that the coated clearcoling layer resin was not heated by infrared ray, the resulting photosensitive medium (Sample B') had spots of 1–2 mm. in diameter at a rate of 4–7 spots per 10 $cm^2$ caused by penetration of the electrically-insulating layer coating material, and the resulting copy image had black points at the white original parts and white points at the black original parts.

Table 2 below shows results of environment test for the above mentioned photosensitive media.

Table 1-continued

Humid atmosphere : stood at 35° C., 85% RH, for 48 hours

| | Resin of clearcoling layer | Electrostatic contrast at a dry state | Electrostatic contrast immediately after stood in the humid atmosphere |
|---|---|---|---|
| sample 2 | | | |

Table 2

| | Stood at 35° C., 85% RH, for 48 hours | | |
|---|---|---|---|
| | Clearcoling layer: Resin, liquid coating, and heat treating | Electrostatic contrast at a dry state | Electrostatic contrast immediately after stood in the humid atmosphere |
| Sample B | Ethylene-acrylic acid resin, aqueous ammonia dispersion, and heated | 630 V | 620 V |
| Sample B' | Ethylene-acrylic acid resin, aqueous ammonia dispersion, and not heated | 630 V | 620 V |
| Control sample 3 | Ethylene-acrylic acid resin, aqueous NaOH dispersion, and heated | 540 V | 10 V |

Control sample 3:

An electrophotographic photosensitive medium produced by repeating the procedure for producing Sample B except that the clearcoling layer was formed by applying a liquid coating composed of ethylene-acrylic acid resin dispersed in an aqueous sodium hydroxide.

As shown in Table 2 above, Sample B does not show any lowering of electrostatic contrast at a humid state while electrostatic contrast of Sample 3 is lowered to a great extent at a humid state. Though Sample B' hardly shows lowering of electrostatic contrast at a humid state, Sample B' is not practically used owing to the spot penetration of the electrically-insulating layer coating material. Sample B indicates the advantage of the present invention.

EXAMPLE 3

A photoconductive layer of 50 microns thick was formed on an aluminum plate in a way similar to Example 1.

Then an aqueous solution (70 cps. at 20° C.) of vinyl acetate-vinyl chloride-acrylic acid copolymer resin (acid value: about 110) in an aqueous ammonia was coated on the photoconductive layer by a dip-coating (pulling out at a speed of 40 mm./min.), and dried at 80° C. for 10 min. to produce a clearcoling layer of 4 microns thick.

On the resulting clearcoling layer was coated a light-curing type urethan-acryl resin ("SONNE CK-8", trade name, supplied by Kansai Paint Corp.) in ethyl alcohol in the same way as Example 1 to form an electrically-insulating layer. Thus, an electrophotographic photosensitive medium was obtained.

An electrophotographic process similar to Example 1 was applied to the resulting electrophotographic photosensitive medium and copy images of very high quality were obtained. Environment characteristics of the above mentioned electrophotographic photosensitive medium (Sample C) are shown in Table 3 below.

Table 3

| | Stood at 35° C., 85% RH, for 48 hours | |
|---|---|---|
| | Electrostatic contrast at a dry state | Electrostatic contrast immediately after stood in the humid atmosphere |
| Sample C | 620 V | 530 V |

As shown in Table 3 above, Sample C shows somewhat decrease in electrostatic contrast at a humid state as compared with Sample A and Sample B. This decrease is due to the higher acid value of the clearcoling layer resin of Sample C than that of each of Sample A and Sample B. Such decrease is, however, only a minor disadvantage and Sample C can be practically used in a highly humid atmosphere while Control samples 1 and 3 can not used in such as atmosphere.

EXAMPLE 4

100 parts by weight of activated cadmium sulfide, 10 parts by weight of polyvinyl butyral resin, and 10 parts by weight of methyl isobutyl ketone as a diluent were mixed and thoroughly dispersed by a roll-mill to produce a paste-like photoconductive composition. Methyl ethyl ketone was added to the resulting composition to adjust the viscosity to 650 cps. at 20° C. An aluminum cylindrical drum was dipped in the liquid composition, pulled out at a speed of 30 mm./min., and dried at 70° C. for 20 min. to evaporate completely the solvent to produce a photoconductive layer of 45 microns thick.

The drum thus coated was dipped in an aqueous dispersion produced by neutralizing carboxyl groups of vinyl acetate-methacrylic acid copolymer resin with ammonia, pulled out at a speed of 30 mm./min., and dried at 70° C. for 30 min. to evaporate water and ammonia and produce a clearcoling layer of 4 microns thick on the photoconductive layer. Further, in a way similar to the procedure of Example 1 there was formed an electrically-insulating layer of 30 microns thick composed of a light curing type urethane-acryl resin on the clearcoling layer.

The electrically-insulating layer of the electrophotographic photosensitive medium thus produced has a uniform thickness and a highly smooth-surface and is completely free from air bubbles.

Toner transferred images obtained in a way similar to Example 1 shows an excellent image quality, and even when the electrophotographic photosensitive medium is repeatedly used more than 10,000 times, the surface of the electrically-insulating layer is not damaged at all and is not subjected to any electric damage and retains the original state. The resulting transferred images are almost the same image quality.

When the electrophotographic photosensitive medium was stood in a highly humid atmosphere (35° C., 80% RH) for 48 hours and directly thereafter the electrostatic latent image was measured, it showed an excellent environment characteristics.

EXAMPLE 5

In a way similar to Example 1, a photoconductive layer of 50 microns thick was formed on an aluminum base, then dipped in an aqueous coating material (80 cps. at 20° C.) prepared by neutralizing ethylene-acrylic acid copolymer resin with an aqueous mixture of ammonia and isopropylamine (1:1 by volume), pulled out at a speed of 30 mm./min. and dried by heating at 70° C. for 20 min. to produce a clearcoling layer of 6 microns thick. Then, immediately, the clearcoling layer was irradiated by a 600 W infrared ray heater at a distance of 3 cm. for 5 sec. to melt and flow the resin to finish the clearcoling layer. On the resulting clearcoling layer was coated a solution (75 cps. at 20° C.) of a light-curing type urethane-acryl resin ("SONNE CK-8", trade name, supplied by kansai Paint Corp.) in a mixture of methyl alcohol and methyl ethyl ketone (1:1) by a dip-coating in a way similar to Example 1 to produce an electrically-insulating layer. Thus an electrophotographic photosensitive medium was produced, which showed excellent electrophotographic characteristics almost similar to those in Examples 1 and 4.

EXAMPLE 6

The procedure of Example 1 was repeated except that an aqueous coating material obtained by neutralizing vinyl acetate-ethylene sulfonic acid copolymer resin was employed for producing a clearcoling layer, and an electrophotographic photosensitive medium was produced. The surface layer of the photosensitive medium, that is, the electrically-insulating layer surface, was very smooth and the thickness of said electrically-insulating layer was uniform.

When an electrophotographic process similar to Example 1 was applied to the photosensitive medium, the transferred toner image was of excellent image quality.

Furthermore, electrophotographic characteristics of the photosensitive medium was hardly deteriorated even when repeatedly used and the photosensitive medium was very practical.

We claim:

1. An electrophotographic photosensitive member which comprises a photoconductive layer composed of a photoconductor dispersed in an insulating organic polymer binder, a clearcoling layer having a thickness of from 0.5 to 10 microns on said photoconductive layer, said clearcoling layer consisting essentially of a water-insoluble organic polymer containing carboxylic acid or sulfonic acid groups and which is water-insoluble when said acid groups are in the acid form and water-dispersible or water-soluble when said acid groups are neutralized with a base, and a smooth-surfaced electrically-insulating layer capable of retaining an electrostatic charge form on said clearcoling layer, said acid groups being not more than five moles per one kilogram of the polymer.

2. An electrophotographic photosensitive member according to claim 1 in which the amount of the acid group is not more than 3 mole per one kilogram of the polymer.

3. An electrophotographic photosensitive member according to claim 1 in which the amount of the acid group is not more than 1 mole per one kilogram of the polymer.

4. An electrophotographic photosensitive member according to claim 1 in which the polymer is selected from the group consisting of vinyl acetate-acrylic acid copolymer, vinyl chloride-vinyl acetate-acrylic acid terpolymer, ethylene-acrylic acid copolymer, styrene-acrylic acid copolymer, butadiene-acrylic acid copolymer, $\alpha,\omega$-polybutadiene dicarboxylic acid, vinyl acetate-ethylene sulfonic acid copolymer, styrene-ethylene sulfonic acid copolymer, vinyl acetate-methacrylic acid copolymer, vinyl chloride-methacrylic acid copolymer, and styrene-methacrylic acid copolymer.

5. An electrophotographic photosensitive drum element which comprises a cylindrical, electrically conductive base, a seamless photoconductive layer on said base and composed of a photoconductor dispersed in an insulating organic polymer binder, a seamless clearcoling layer having a thickness of from 0.5 to 10 microns on said photoconductive layer, said clearcoling layer consisting essentially of a water-insoluble organic polymer containing carboxylic acid or sulfonic acid groups and which is water-insoluble when said groups are in the acid from and water-dispersible or water-soluble when said acid groups are neutralized with a base, and a seamless, smooth surfaced electrically insulating layer capable of retaining an electrostatic charge formed on said clearcoling layer, said acid groups being not more than five moles per one kilogram of the polymer.

6. An electrophotographic photosensitive drum element according to claim 5 in which the amount of the acid group is not more than 3 moles per one kilogram of the polymer.

7. An electrophotographic photosensitive drum element according to claim 5 in which the amount of the acid group is not more than 1 more per one kilogram of the polymer.

8. An electrophotographic photosensitive drum element according to claim 5 in which the polymer is selected from the group consisting of vinyl acetate-acrylic acid copolymer, vinyl chloride-vinyl acetate-acrylic acid terpolymer, ethylene-acrylic acid copolymer, styrene-acrylic acid copolymer, butadiene-acrylic acid copolymer, $\alpha,\omega$-polybutadiene dicarboxylic acid, vinyl acetate-ethylene sulfonic acid copolymer, styrene-ethylene sulfonic acid copolymer, vinyl acetate-methacrylic acid copolymer, vinyl chloride-methacrylic acid, and styrene-methacrylic acid copolymer.

9. A process for manufacturing an electrophotographic photosensitive member which comprises the steps of:

forming a photoconductive layer composed of a photoconductor dispersed in an insulating organic polymer binder on a base, applying to the surface of said photoconductive layer an aqueous coating material produced by neutralizing a water-insoluble organic polymer containing carboxylic acid or sulfonic acid groups with a basic compound to render said polymer water-dispersible or water-soluble and dissolving or dispersing the polymer thus neutralized in water, said acid groups being not more than five moles per one kilogram of the polymer.

drying the aqueous coating material thus applied to produce a clearcoling layer which is water-insoluble, wherein the aqueous coating material is applied in an amount to form a clearcoling layer having a thickness from 0.5 to 10 microns, and forming a smooth-surfaced electrically-insulating layer capable of retaining an electrostatic charge on the clearcoling layer.

10. A process according to claim 9 in which the basic compound is a volatile basic compound.

11. A process according to claim 10 in which the volatile basic compound is selected from the group consisting of ammonia and volatile lower alkyl amines.

12. A process according to claim 9 in which the aqueous coating material is the neutralized polymer dispersed in water and further comprising the step of heating the polymer to a temperature higher than its melting point after it has been coated on the surface of said photoconductive layer.

13. A process for manufacturing an electrophotographic photosensitive member which comprises the steps of:

forming a photoconductive layer composed of a photoconductor dispersed in an insulating organic polymer binder on a base, applying to the surface of said photoconductive layer an aqueous coating material produced by neutralizing with ammonia or a lower alkyl amine a water-insoluble organic polymer containing carboxylic acid or sulfonic acid groups to render said polymer water-dispersible or water-soluble, the acid group being present in an amount of from 0.1 to 5 moles per one kilogram of the polymer, and dissolving or dispersing the polymer thus neutralized in water, drying the aqueous coating material thus applied to produce a clearcoling layer which is water-insoluble, wherein the aqueous coating material is applied in an amount to form a clearcoling layer having a thickness from 0.5 to 10 microns, and forming a smooth-surfaced electrically-insulating layer capable of retaining an electrostatic charge on the clearcoling layer.

14. A process according to claim 13 in which the neutralized polymer is dispersed in water and further comprising the step of heating the polymer to a temperature higher than the melting point of the polymer after the aqueous material is coated on the surface of said photoconductive layer.

* * * * *

UNITED STATES PATENT AND TRADEMARK OFFICE

CERTIFICATE OF CORRECTION

PATENT NO. : 4,190,445

DATED : February 26, 1980

INVENTOR(S) : TERUOMI TAKAHASHI AND TAKEHIKO MATSUO

It is certified that error appears in the above—identified patent and that said Letters Patent is hereby corrected as shown below:

Col. 1, line 58, "7,734,609" should be --3,734,609--.

Col. 11, line 10, 3rd column, "620" should be --630--.

Signed and Sealed this

*Twelfth* Day of *June 1984*

[SEAL]

*Attest:*

GERALD J. MOSSINGHOFF

*Attesting Officer*

*Commissioner of Patents and Trademarks*